United States Patent [19]

Kunz

[11] 4,140,359

[45] Feb. 20, 1979

[54] ELECTRICAL CONNECTOR HAVING A ONE-HAND DISCONNECT EJECTOR

[75] Inventor: Raymond W. Kunz, Monroe, Conn.

[73] Assignee: Clairol Inc., New York, N.Y.

[21] Appl. No.: 823,305

[22] Filed: Aug. 10, 1977

[51] Int. Cl.[2] ..... H01R 13/62

[52] U.S. Cl. ..... 339/45 R

[58] Field of Search ..... 339/45 R, 45 M, 45 T, 339/46, 110 P; 29/764

[56] References Cited

U.S. PATENT DOCUMENTS

| | | | |
|---|---|---|---|
| 2,053,386 | 9/1936 | Wheeler | 339/45 R |
| 2,142,284 | 1/1939 | Park | 339/45 R |
| 2,445,608 | 7/1948 | Detweiler | 339/45 R |
| 3,160,947 | 12/1964 | Sunderlin | 339/45 R |
| 3,215,971 | 11/1965 | Caparosa | 339/110 P |

*Primary Examiner*—Neil Abrams

*Attorney, Agent, or Firm*—John A. Caruso; George A. Mentis; David J. Wingford

[57] ABSTRACT

An electrical connector for attaching an electrical cord to an electrical appliance is provided. The connector has an ejector which allows for one hand disengagement of the connector and cord from the appliance. The ejector has a first portion movable through and out of the connector and an integral hinge shaped second portion. By application of finger pressure on the second portion to flatten it, the first portion is moved out of the connector and against the appliance causing an oppositely directed movement of the connector, thereby disengaging the connector and cord from the appliance.

1 Claim, 6 Drawing Figures

ELECTRICAL CONNECTOR HAVING A ONE-HAND DISCONNECT EJECTOR

BACKGROUND OF THE INVENTION

This invention relates to an electrical connector. More particularly, it relates to a connector for attaching an electrical cord to an electrical appliance, which connector includes an ejector by which it and the cord may be detached from the appliance.

Electrical appliances having detachable cords are well known. One advantage of such an appliance is that once the appliance is electrically activated, the cord can be detached therefrom and the appliance can be moved about freely and used without being restricted by the cord. However, certain appliances, particularly those having an outer cover made of metal, may become hot when electrically activated. To remove the cord from such an appliance is difficult without touching it. Also, when using certain electrical appliances, such as a heated hair drying cap, the user may not have one hand free to hold the cap while disconnecting the cord therefrom with another free hand.

Thus, it is desirable to equip an electrical cord with an electrical connector that can be detached from an appliance without touching the appliance and with one hand. The connector of the present invention solves these problems because it can be operated with one hand by application of finger pressure on the ejector of the connector.

Ejectors for use with electrical connectors are known. For instance, U.S. Pat. Nos. 1,900,782; 2,051,425; 2,134,345; 2,142,184, 2,703,869; and 3,440,405 disclose electrical connectors having ejectors which operate on a cam principle. U.S. Pat. Nos. 1,531,604; 2,259,799; 2,445,608; and 3,737,623 disclose bar or plunger operated ejectors. U.S. Pat. No. 2,955,273 discloses a spring operated ejector for an electrical connector. Other state of the art patents known to the applicants herein are U.S. Pat. Nos. 2,926,230; 3,417,214; 3,573,695; and 3,587,021.

Two ejectors of this invention are cam operated. A third ejector herein is operated on the "hinge" principle described in detail below. Such ejectors do not have the same construction nor operate in the same manner as do the prior art ejectors mentioned above.

SUMMARY OF THE INVENTION

In an electrical connector, an ejector is provided for disengaging the connector and an electrical cord attached thereto from an electrical appliance. The ejector includes first and second components. The first component is movable through and out of the connector to bear against the appliance when the connector engages the appliance and the second component is movable by the application of pressure thereon to cause movement of the first component against the appliance, whereof the connector is moved in an opposite direction and disengaged from the appliance. Preferably the first component is a flat bar and the second component is integral with the first component and has a hinge shape. By finger pressure on the second component to flatten it, the first component is moved against the appliance and the connector is disengaged from the appliance.

BRIEF DESCRIPTION OF THE DRAWINGS

The electrical connectors of this invention are described in detail below and should be studied in conjunction with the drawings of this application, which are as follows.

DETAILED DESCRIPTION OF THE INVENTION

Figure 1:
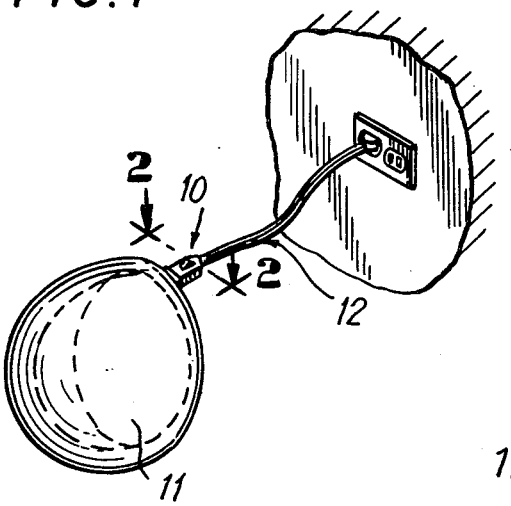
FIG. 1 is a perspective view of an electrical connector of this invention having one end attached to a hair drying cap and the other end attached to an electrical cord.

An electrical connector of this invention is shown in FIG. 1, wherein it is indicated at 10. As described below, one end of the connector is removably attachable to an appliance, such as the hair drying cap generally indicated at 11 in FIG. 1, and the other end of the connector is fixedly attached to an electrical cord 12. The cord has at its other end a conventional plug 13 for connecting the appliance to a power source.

Figure 2:
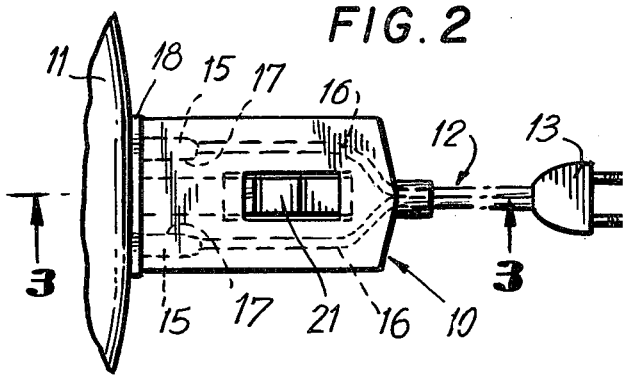
FIG. 2 is an enlarged, plan view of the structures of FIG. 1 showing the electrical components thereof in dotted line.

Referring to FIG. 2, the structures of cap 11 relevant to this invention include a plate 14 affixed to the outside of the cap, a heating element (not shown) within the cap, and electrical terminals 15 extending out of the cap through plate 14 and in electrical contact with the heating element. The structures of cord 12 relevant to this invention include wires 16 extending into connector 10. At the free end of each of the wires is a contact 17. The structure of the contacts is not critical to this invention. Generally the contacts will have a structure corresponding to that of terminals 15, so that current may be delivered from the power source through plug 13, cord 12, contacts 17, and terminals 15 into the heating element of cap 11.

Figure 3:
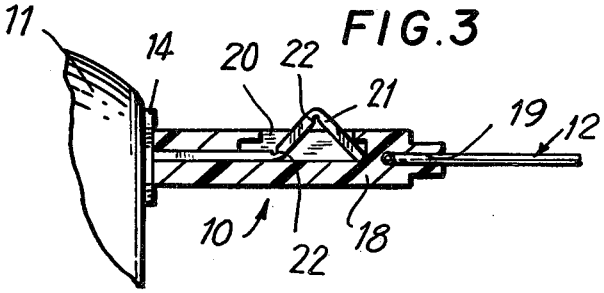
FIG. 3 is a side view of the electrical connector of FIG. 1 showing particularly the ejector of the connector.

The structure of connector 10 is best shown in FIG. 3. The connector includes a base 18 and several openings. A first opening 19 is provided for receiving wires 16 of cord 12, as described above. A pair of openings (not shown) are provided in which contacts 17, which are attached to wires 16, are received. Finally, the irregular shaped opening 20, shown best in FIG. 3, is provided in which an ejector 21 is received. Opening 20 extends horizontally through base 18 from the end of connector 10 adjacent plate 14 into generally the center of the connector, where it widens and extends vertically upward to the top surface of the connector. The reason for the irregular shape of opening 20 will be apparent from the discussion below concerning ejector 21.

Referring again to FIG. 3, ejector 21 is made of, preferably, a flexible plastic and has essentially two portions. The first portion is flat and extends between the outermost end of the connector adjacent plate 14 and the upwardly extending section of opening 20. The second portion of ejector 21 has the shape of a "hinge" or is triangular in shape and extends out of the upwardly extending section of opening 20 of connector 10 when the connector is attached to cap 11.

Figure 4:
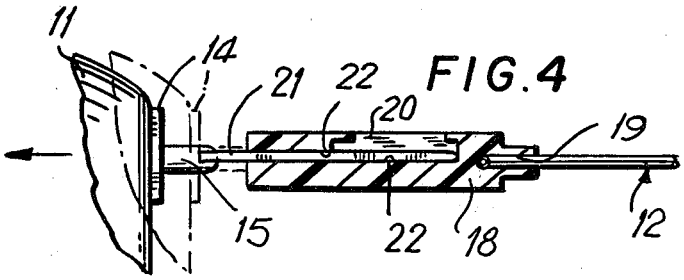
FIG. 4 is a side view of the electrical connector of FIG. 1 showing the ejector thereof after it has been operated to disengage the connector from the cap.

When the ejector is in the position shown in FIG. 3, contacts 17 engage terminals 15, as shown in FIG. 2, and current may be delivered through the connector to heat the cap. To disengage the connector from the cap and prevent current flow thereto, finger pressure is applied to the hinge shaped portion of ejector 21, so that the ejector assumes the position shown in FIG. 4. As indicated by the arrow in FIG. 4, such a pressure application causes the first portion of ejector 21 to push against plate 14, thereby causing an oppositely directed movement of the connector and disengagement of terminals 15 from contacts 17. To facilitate "flattening" of ejector 21, flex points are provided in the ejector by slots 22. Further, once finger pressure is removed from the ejector, the hinge shaped portion of the ejector, which was flattened, resumes its initial shape shown in FIG. 3 and the ejector may again be operated.

Thus, with one hand, ejector 21 can be operated to detach connector 10 from cap 11 without the operator having to touch the cap.

Figure 5:
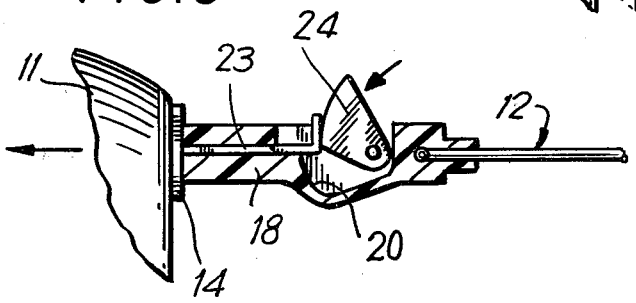
FIG. 5 is a side view similar to FIG. 3 of another electrical connector of this invention.
Figure 6:
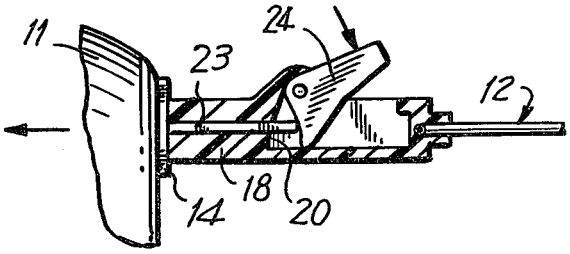
FIG. 6 is a view similar to FIG. 3 of still another electrical connector of this invention.

In FIGS. 5 and 6, other ejectors, which operate on a cam principle, are shown. Unlike ejector 21 described above, the ejectors of FIGS. 5 and 6 are made of two separate components. In each case, these ejectors utilize a flat bar component, generally indicated at 23, which is similar to the first portion of ejector 21 described above, for contacting plate 14 to disengage the connector from cap 11. To do so, a second cam component, generally indicated at 24, is moved in the direction of the arrows shown to act on component 23.

To once again engage the connectors of FIGS. 5 and 6 with cap 11, terminals 15 of the cap are engaged with contacts 17 causing the respective ejectors shown to resume their initial positions because the flat bar components thereof are pushed away from terminals 15 and return springs or similar means (not shown) operate to return the cam components to the positions shown in FIGS. 5 and 6.

The above description of the electrical connectors of this invention should not be interpreted to define this invention, which is accomplished by the claims appended hereto.

What is claimed is:

1. In an electrical connector for connecting an electrical cord to an appliance for delivery of current from a power source through the cord into the appliance, an ejector for disconnecting the appliance from the connector, the ejector comprising first and second components, the first component being flat, the second component being hinge shaped, and the second component being capable of assuming a flat shape, similar to the first component, upon the application of pressure thereto, the first component is movable through and partially out of the connector, whereby upon application of pressure to the second component when the appliance and connector are connected, the first component is moved in one direction against the appliance and the connector is moved in opposite direction and is disconnected from the appliance.

* * * * *